United States Patent [19]

Funfstuck

[11] Patent Number: 4,500,016

[45] Date of Patent: Feb. 19, 1985

[54] ROTATABLE CLOSURE AND DISPENSING DEVICE FOR COLLAPSIBLE TUBES AND/OR CONTAINERS

[76] Inventor: Horst Funfstuck, 364 W. Payson St., Glendora, Calif. 91740

[21] Appl. No.: 450,333

[22] Filed: Dec. 16, 1982

[51] Int. Cl.[3] ..... B65D 35/48

[52] U.S. Cl. ..... 222/153; 222/498; 222/520; 222/557; 222/542

[58] Field of Search ..... 222/498–499, 222/153, 545–546, 556–557, 549, 552, 542, 520; 215/250, 253, 332, 330; 220/253, 265–266

[56] References Cited

U.S. PATENT DOCUMENTS

| | | | |
|---|---|---|---|
| 1,891,031 | 12/1932 | Arsdale | 222/545 |
| 2,123,907 | 7/1938 | Masbach et al. | 222/498 |
| 2,943,771 | 7/1960 | Driscoll | 222/498 X |
| 3,104,039 | 9/1963 | Dike | 222/545 X |
| 3,860,148 | 1/1975 | Sherin | 220/266 X |

FOREIGN PATENT DOCUMENTS

| | | | |
|---|---|---|---|
| 1576126 | 10/1980 | United Kingdom | 222/545 |

*Primary Examiner*—Charles A. Marmor

[57] ABSTRACT

A rotatable closure and dispensing device for collapsible tubes and/or containers, wherein a cap member is rotatably mounted to the nozzle of a tube. The cap is formed having a discharge port which is offset from the central axis of the cap and the nozzle, so as to be rotatably aligned with a second discharge port disposed in the nozzle. The cap and nozzle are provided with interlocking members whereby the cap can be sealed and locked in either an open or a closed position. The cap includes a tamper indicator that must be broken in order to rotate the cap.

4 Claims, 6 Drawing Figures

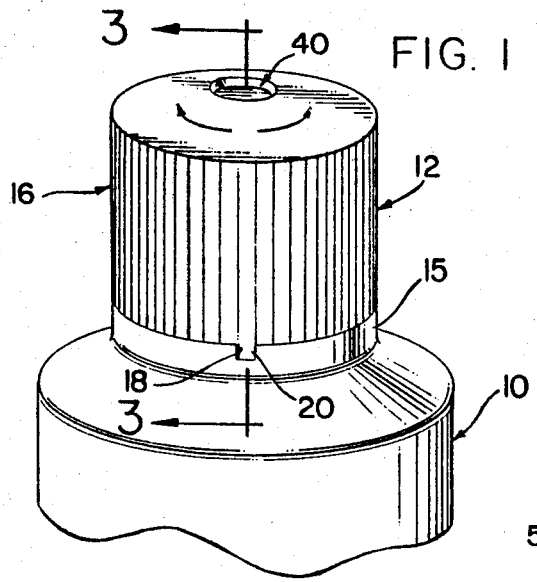
FIG. 1
FIG. 2
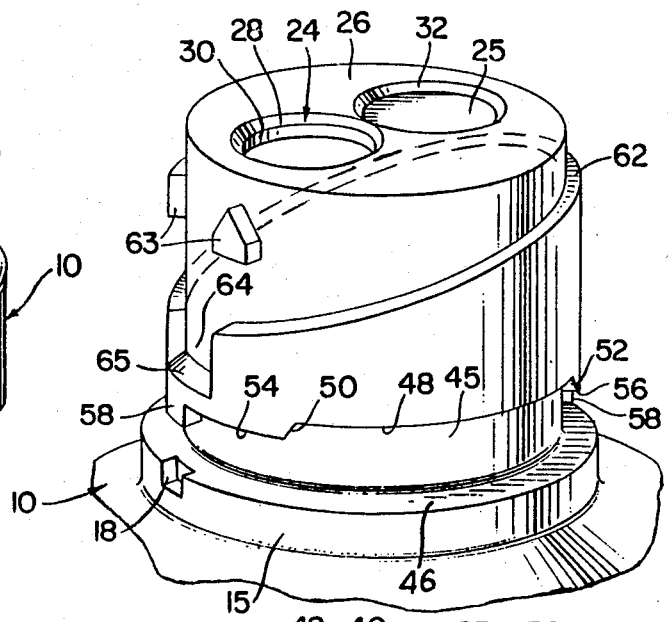
FIG. 3
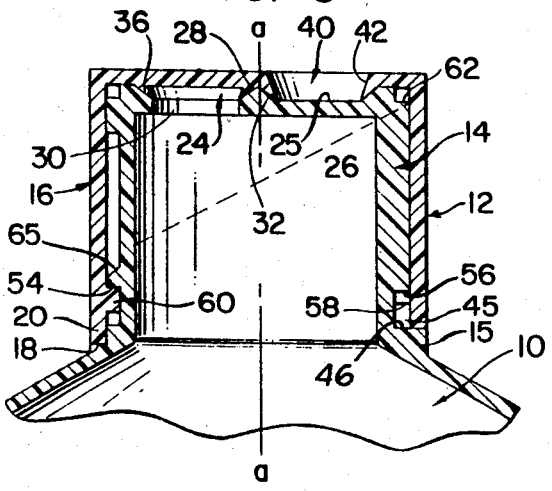
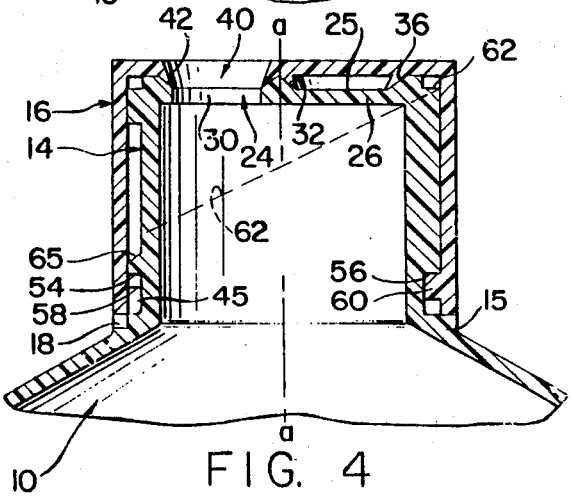
FIG. 4
FIG. 6
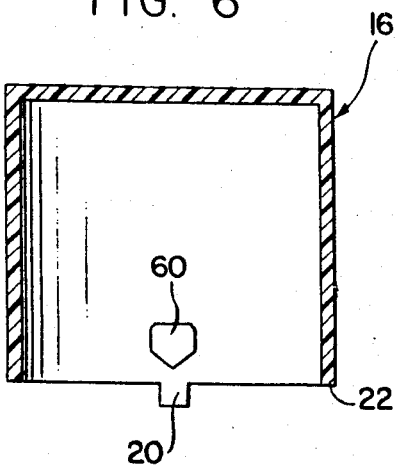
FIG. 5
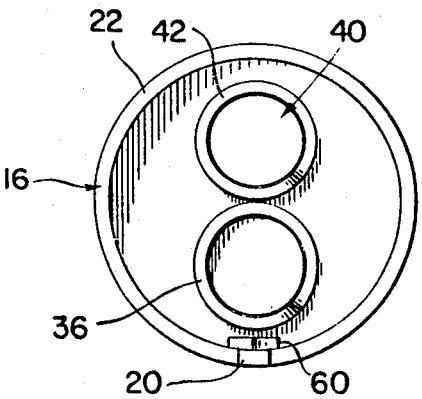

ROTATABLE CLOSURE AND DISPENSING DEVICE FOR COLLAPSIBLE TUBES AND/OR CONTAINERS

BACKGROUND OF THE INVENTION

Field of the Invention

The present invention relates generally to a device for controlling the discharge of substances stored in collapsible tubes or like containers, and more particularly to a rotatable closure mounted to an extended neck member formed as part of a collapsible tube and/or container.

There are many known devices that have been or are being employed to control the dispensing of substances, such as toothpaste, shaving cream, gel, glue, cement, etc., from collapsible tubes. However, these known types of tube-closure devices have features that limit the types of substances that can be dispensed from a container. Also, while they are expensive to manufacture, these devices still do not provide a means to indicate when a container cap or closure has been tampered with.

As examples of various closure devices for collapsible tubes, the following U.S. patents are noted in the existing art:

U.S. Pat. No. 1,685,147 to O. B. Case discloses a container having a revolvable cap, the cap and the neck members being threadless. The cap is formed and mounted to the neck member for unrestricted rotation in either direction.

U.S. Pat. No. 2,138,992 to M. Baker discloses a closure for collapsible tubes which comprises a rotatable outer cap member having a limit pin adapted to be moved in a restricted groove formed in an inner cap member, the inner cap member being threadably secured to the neck of the tube.

U.S. Pat. No. 3,198,406 to A. W. Kopelman discloses another two-part cap unit whereby the outer cap member rotates about an inner cap member, the inner cap member being provided with internal threads, so as to be threadably mounted to the collapsible tube.

Other patents of interest are U.S. Pat. Nos. 2,682,355 and 3,439,843.

SUMMARY AND OBJECTS OF THE INVENTION

The present invention discloses a rotatable closure device for collapsible tubes and/or containers, whereby the extended neck portion of the tube or container is formed as part of the closure device. The neck member includes a discharge opening offset from the central axis thereof, and a detent disposed adjacent the opening. The cap member is formed so as to be rotatably secured over the neck member; and it includes a discharge opening which must be aligned over the opening of the neck member. The cap further includes a depending protruberance which is adapted to lock the cap in an open or a closed position. There is also provided a tamper indicator in the form of a depending pin which is received in a compatible recess. The cap cannot be rotated until the pin is broken. A keeper member is formed on the inner wall of the cap, and is positioned to be received in an annular groove formed in the base of the neck member which controls both vertical and rotatable movements of the cap.

Accordingly, it is an important object of the present invention to provide an improved rotatable closure mechanism for collapsible tubes and/or containers wherein the neck of the tube or container forms part of the closure mechanism, and the cap remains attached to the tube or container.

It is another object of the invention to provide an adjustable cap mechanism for dispensing a semi-liquid or paste material from collapsible tubes and/or containers wherein the cap includes means for locking the cap in an open or a closed position.

It is still another object of the invention to provide an improved dispenser mechanism of the type which includes sealing members that cause the cap to be tightly sealed against leaks when in a closed position, and which prevents excessive flow of fluid or paste from the surrounding wall of the cap when in an open dispensing mode.

Still another object of the invention is to provide a device of this character that can be readily opened and closed, and that prevents messiness due to dripping by incorporating a positive closing and sealing mechanism which thus reduces contact between the hands and the dispensed product.

It is a further object of the invention to provide a dispenser mechanism of this character that is easy to operate and maintain, and that is simple and rugged in construction.

A still further object of the invention is to provide a dispenser mechanism having a cam action to allow the cap to be pushed onto the neck by means of automatic assembly machines, by providing a cam mechanism that always aligns the cap and the neck into the closed position and the tamper indicator into its groove.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of the dispensing mechanism constructed according to the invention, as it appears when attached to the neck portion of the container;

FIG. 2 is a perspective view of the neck portion of the collapsible tube;

FIG. 3 is an enlarged cross-sectional view of the cap member in a locked closed position;

FIG. 4 is an enlarged cross-sectional view similar to that seen in FIG. 3, except that the cap member has been rotated 180° to a fully open position;

FIG. 5 is a bottom-plan view showing the location of the discharge opening relative to the locking-blank member; and FIG. 6 is a cross-sectional view of the cap member.

DESCRIPTION OF THE PREFERRED EMBODIMENT

Referring to FIG. 1, there is shown a container, generally indicated at 10, which is herein illustrated as a collapsible tube, such as commonly used for toothpastes medications, gels, glues, and other substances of like consistency.

The present invention, a rotatable closure and dispensing device, designated generally at 12, is formed and mounted to the tube 10. That is, tube 10 is formed having an extended neck member 14 which defines a discharge nozzle on which a cap member 16 is adjustably mounted.

Discharge nozzle 14 is formed as an integral part of the tube body and comprises an annular enlarged base 15 having a recess or notch 18 which is adapted to receive the depending tongue or pin member 20 formed so as to project downwardly from the lower edge 22 of cap 16, as shown in FIGS. 1, 3 and 6. The tongue and notch together form a tamper-indicating means. If the cap 16 is rotated to an open position, tongue 20 is broken off from the edge of the cap, thus indicating that the cap has aleady been unsealed or tampered with.

Nozzle 14 is further provided with a first discharge port or opening 24 formed in the top closure wall 26, the port having an inclined tapered upper wall 28 and a smaller-diameter lower wall 30. Juxtapositioned to port 24 is a blank matching annular detent 25 having an inclined tapered annular wall 32 which is identical to wall 28 of port 24.

Because of the tapered configuration of port 24 and the detent 25, they are adapted to receive a locking means formed on the underside of the top closure wall 35 of cap 16. The locking means comprises a depending annular tapered lip member 36 which is adapted to be selectively positioned in the blank detent 25 when cap 16 is in a locked closed position, and to be readily received in discharge port 24 when in a locked open position.

To aid in providing a locked as well as a sealed cap member, a second discharge port or opening 40 is formed in cap 16 having a similar depending tapered lip member 42. In FIG. 3, cap 16 is seen in a locked closed position, whereby annular lip 36 is mated with annular wall 28 of discharge port 24 and annular lip 42 is received in detent 25, thus engaging the tapered annular wall 32.

Accordingly, FIG. 4 illustrates the reverse position of cap 16; that is, cap 16 is in a locked open mode having port 40 superposed over port 24, whereby annular lip 42 engages annular wall 28 of port 24, and annular lip 36 engages the blank detent 25.

To establish an adjustable rotating means, there is formed in neck or nozzle member 14 an annular groove 45 just above base 15. The lower wall 46 of groove 45 is defined by base 15; and the upper wall 48 is formed having oppositely disposed cam surfaces 50 and 52, respectively, and lower walls 54 and 56, respectively, both defining a cam means. Each lower wall 54 and 56 terminates with a stop means indicated by shoulder 58.

Cap member 16 is provided with an inwardly projecting keeper member 60 which is aligned above tongue 20, as better seen in FIG. 6. This alignment allows cap 16 to be fitted over neck 14 so as to align tongue 20 with notch 18. To aid in the alignment when capping the neck or nozzle 14, there is formed on neck 14 a cam deflector 62 and a pair of deflector lug members 63 which guide keeper 60 into position over gap 64 which forms part of the tube neck 14.

Gap 64 has an inclined wall 65 whereby keeper 60 is forced over wall 65 into groove 45, the tongue 20 being received in notch 18 in base 15. Keeper 60 is positioned so as to fit tightly under lower wall 54 defining a compression means, thus causing cap 16 to be forceably engaged in a locking and sealing engagement with nozzle 14 when in a closed position.

To position the dispenser cap 16 in a locked open mode as seen in FIG. 4, the cap must be twisted whereby keeper 60 disengages wall 54 and moves to the opposite side, thus engaging cam member 52 which again compresses or pulls cap 16 into a locked and sealed position, and causing keeper 60 to engage under wall 56. Rotation of the cap is generally on the axis a—a of nozzle 14, and is limited to 180° by shoulder-stop means 58.

As keeper 60 passes through the enlarged section of groove 45, the cap is loosened, allowing the depending annular lip members 36 and 42 to disengage from the respective discharge port 24 and detent 25.

The present disclosure shows that a counter-clockwise rotation is required to position the cap in an open position; however, it should be understood that a clockwise rotation is also possible.

Accordingly, when closing and locking the cap, keeper 60 engages cam surface 50, thus compressing cap 16 as keeper 60 is held under wall 54.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A rotatable closure and dispensing device for collapsible tubes and/or containers, comprising:

a collapsible tube adapted to store various fluids or pastes therein;

a nozzle integrally formed on said tube or container, and having a discharge port and a blank detent formed therein;

a cap member rotatably mounted to said nozzle, said cap member having a discharge port formed therein for alignment with said discharge port of said nozzle;

means formed on said nozzle and said cap member for selectively positioning said cap member on said nozzle;

means for locking and sealing said cap member in an open or closed position;

wherein said locking and sealing means comprises:

said blank detent formed in said nozzle adjacent said nozzle-discharge port;

a first depending annular lip member formed about said cap discharge port, and adapted to be selectively positioned in said nozzle discharge port or said blank detent; and a second depending annular lip member formed in said cap member adjacent said cap-discharge port, and adapted to be selectively positioned in said nozzle-discharge part or said blank detent;

an annular groove formed in said nozzle having a lower wall defining a nozzle-base member, and an upper wall formed having cam means at opposite sides thereof; and a keeper member formed on said cap adapted to move within said groove and engage each cam means, either of said cam means being engaged when said cap is in an open or closed mode, whereby said cap is compressed against said nozzle in a locked and sealed position;

wherein said nozzle-discharge port and said blank detent are formed having inclined annular walls, and said depending annular lip members are formed having inclined walls for matching engagement with said respective inclined walls of said nozzle-discharge port and said detent;

tamper-indicating means formed between said cap and said nozzle, whereby said tamper-indicating means must be broken prior to placing said cap in an open position;

wherein said tamper-indicating means comprises:

a depending tongue member integrally formed along the lower edge of said cap member; and a notch formed in said base member of said nozzle, and adapted to receive said tongue member when said cap is mounted to said nozzle; and wherein said positioning means of said cap member on said nozzle comprises:

a cam deflector formed on said nozzle;

a pair of deflector-lug members formed on said nozzle; and a positioning gap formed at the base of said cam deflector and above said notch in said nozzle base, said cam deflector and said deflector-lug members being positioned to guide said keeper member which is to be received and passed over said positioning gap, whereby said keeper member is positioned in said groove and said tongue member is received in said notch.

2. A rotatable closure and dispensing device for collapsible tubes and/or containers, comprising:

a collapsible tube adapted to store various fluids or pastes therein;

a nozzle integrally formed on said tube or container, and having a discharge port and a blank detent formed therein;

a cap member rotatably mounted to said nozzle, said cap member having a discharge port formed therein for alignment with said discharge port of said nozzle;

means formed on said nozzle and said cap member for selectively positioning said cap member on said nozzle;

means for locking and sealing said cap member in an open or closed position; and tamper-indicating means formed between said cap and said nozzle, whereby said tamper-indicating means must be broken prior to placing said cap in an open position;

wherein said locking and sealing means comprises:

said blank detent formed in said nozzle adjacent said nozzle-discharge port;

a first depending annular lip member formed about said cap discharge port, and adapted to be selectively positioned in said nozzle discharge port or said blank detent; and a second depending annular lip member formed in said cap member adjacent said cap-discharge port, and adapted to be selectively positioned in said nozzle-discharge port or said blank detent;

an annular groove formed in said nozzle having a lower wall defining a nozzle base member, and an upper wall formed having cam means at opposite sides thereof; and a keeper member formed on said cap adapted to move within said groove and engage each cam means, either of said cam means being engaged when said cap is in an open or closed mode, whereby said cap is compressed against said nozzle in a locked and sealed position;

wherein said nozzle-discharge port and said blank detent are formed having inclined annular walls and said depending annular lip members are formed having inclined walls for matching engagement with said respective inclined walls of said nozzle-discharge port and said detent; and wherein said positioning means of said cap member on said nozzle comprises:

a cam deflector formed on said nozzle;

a pair of deflector-lug members formed on said nozzle; and a positioning gap formed at the base of said cam deflector said cam deflector and said deflector-lug members being positioned to guide said keeper member which is to be received and passed over said positioning gap, whereby said keeper member is positioned in said groove.

3. A rotatable closure and dispensing device as recited in claim 2, wherein said locking and sealing means includes stop means formed in said groove to limit the rotational movement of said cap.

4. A rotatable closure and dispensing device as recited in claim 3, wherein said stop means comprises a pair of shoulder members positioned 180° apart.

* * * * *